US006819255B2

(12) United States Patent
Chernetski

(10) Patent No.: US 6,819,255 B2
(45) Date of Patent: Nov. 16, 2004

(54) LOAD SIZE DETECTION IN A FABRIC DRYER

(75) Inventor: Fredrick E. Chernetski, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 79 days.

(21) Appl. No.: 10/254,339

(22) Filed: Sep. 25, 2002

(65) Prior Publication Data

US 2004/0066303 A1 Apr. 8, 2004

(51) Int. Cl.[7] ..... G08B 21/00
(52) U.S. Cl. ..... 340/679; 340/635
(58) Field of Search ..... 340/679, 635, 340/331, 691; 34/89, 524, 528

(56) References Cited

U.S. PATENT DOCUMENTS 5,281,956 A * 1/1994 Bashark ..... 340/660
5,467,077 A * 11/1995 Wunderlich et al. ..... 340/635
6,064,043 A * 5/2000 Livers et al. ..... 219/492
6,424,252 B1 * 7/2002 Adler ..... 340/311.2
6,502,265 B2 * 1/2003 Blair et al. ..... 8/159

* cited by examiner

*Primary Examiner*—John Tweel
(74) *Attorney, Agent, or Firm*—John F. Colligan; Robert O. Rice; Stephen Krefman

(57) ABSTRACT

An apparatus for determining an approximate mass of a fabric load in an automatic clothes dryer wherein the dryer utilizes a motor including a centrifugal switch which closes upon the motor achieving a predetermined speed at a start of the motor. A timer device is provided which is capable of timing intervals of time measured in milliseconds. A current detecting mechanism is arranged in a current supply line for the dryer motor and is arranged to start the timer upon detecting a start of the dryer motor. A voltage measuring mechanism is arranged at a power supply for the motor to provide a voltage measurement. An arrangement is provided to detect the closure of the centrifugal switch of the motor and is arranged to stop the timer upon detecting the closure of the centrifugal switch to provide a start time. A calculating device is provided for receiving the start time and the voltage measurement and for providing a calculated mass of the fabric load in the dryer. This calculated mass can have a variety of uses, including determining an approximate drying time for the fabric load utilizing a calculating device and a predetermined formula.

23 Claims, 4 Drawing Sheets

LOAD SIZE DETECTION IN A FABRIC DRYER

BACKGROUND OF THE INVENTION

The present invention relates generally to an automatic clothes dryer.

Automatic clothes dryers are well known and provide various control mechanisms for applying heat and terminating the operation of a tumbling action of the clothes receiving drum once clothes are detected to be dry. It is known to utilize moisture sensors and humidity sensors for detecting when the clothes load is dry and for estimating the remaining time before the clothes load will be dry.

A typical motor used for rotating dryer drums is a split phase induction motor which has a start winding and a main winding. When the dryer is started, a centrifugal switch on the motor shuts off the start winding when the motor reaches a speed high enough to sling out a pair of fly weights on its actuator. Then, a normally open contact on the switch closes. Once the switch is closed, the motor will continue in operation until some other event occurs, such as a detection that a certain dryness level has been achieved by the moisture sensors, a certain pre-selected time period selected by the user has elapsed, or the door to the dryer drum is opened. Any one of these events will open a different switch, thereby removing power from the motor and terminating the tumbling action.

In those dryers where an estimated remaining time to complete the drying cycle is displayed, this estimated time is determined only after the dryer has been operating for at least several minutes. It would be an improvement in the art if a display of remaining time could be provided at approximately the same time that the drying cycle is started.

SUMMARY OF THE INVENTION

The present invention provides an arrangement for detecting the size of the load presented in the dryer drum at the initiation of the drying cycle which can be used to estimate the time remaining for the drying cycle.

Dryers with electronic controls can utilize this remaining time to provide the user with an early estimate of how long it will take to dry the clothes. By estimating the mass in the dryer, a proportion can be used to arrive at an estimated drying time.

A method of determining an estimated drying time of a fabric load in an automatic clothes dryer is provided wherein the dryer utilizes a motor including a centrifugal switch which closes upon the motor achieving a predetermined speed at a start of the motor. This method includes detecting the start of the dryer motor and simultaneously starting a timer. A voltage of the line current used to power the motor is determined, the closure of the centrifugal switch of the motor is detected and the timer is simultaneously stopped to achieve a start time. The start time and the predetermined voltage are used in a predetermined formula for the particular dryer to calculate an approximate mass of the fabric load in the dryer. To utilize this calculated mass, it can be inserted into a formula to approximate a drying time for the fabric load and this approximate drying time can be displayed on a display associated with the dryer less than one second after the start of the drying cycle.

In an embodiment of the invention, an LED is placed in the line conductor for the motor and an optical pickup is used to detect energization of the LED to determine a start of the dryer motor. In an embodiment of the invention, detecting the closure of the centrifugal switch comprises an LED in a line closed by closure of the centrifugal switch and utilizing an optical pickup to detect energization of this LED. In a different embodiment of the invention, detecting the closure of the centrifugal switch includes monitoring a voltage of the power supply and stopping the timer when a change in the monitored voltage is greater than a predetermined amount.

DETAILED DESCRIPTION OF THE PREFERRED EMBODIMENT

Figure 1:
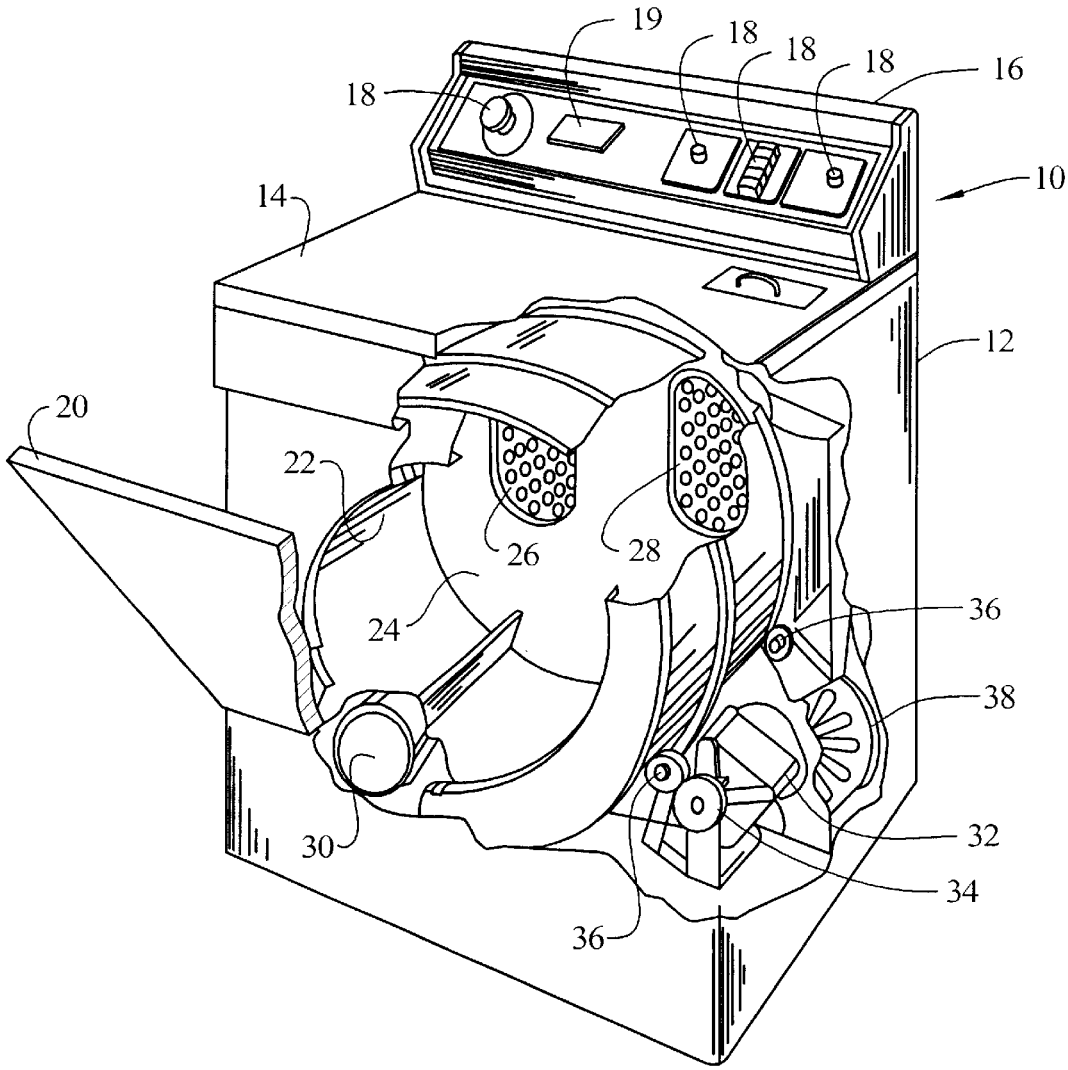
FIG. 1 is a perspective view of an automatic clothes dryer, partially cut away, incorporating the present invention.

In FIG. 1 there is generally shown an automatic clothes dryer at 10 having an exterior cabinet 12 with a top panel 14 having a control console 16 along the rear portion thereof including a plurality of controls 18 for selecting an automatic programmed series of drying steps and an electronic display 19 for displaying various information to the user, including an estimated drying time.

The dryer cabinet 12 has a front openable door 20 providing access to the interior of a rotatable drying drum 22 which rotates about a horizontal axis, and has a non-rotating rear bulkhead 24 with air intakes 26 and air outlets 28 therein for charging the interior of the drum with heated air from a heat source 30 and for exhausting moisture laden air. An electric motor 32 is provided to rotate the drum 22 through a pulley arrangement 34, the drum rotating on a plurality of rollers 36. The motor 32 also drives the fan 38 which provides the air flow through the interior of the drum 22. In a preferred embodiment, the motor 32 is a split phase induction motor having a main winding and a start winding. A centrifugal switch is carried on a rotor of the motor and closes once the rotor has achieved a predetermined speed. This deenergizes the start winding. Of course, other arrangements can be provided between the motor and the drum to effect a driving relationship therebetween including a direct drive arrangement, a gear arrangement and other well known drive connections.

Further, although a single motor 32 is shown to provide the driving of the drum 22 as well as the fan 38, separate motors could be utilized for these two functions.

A method of determining an estimated mass of a fabric load in the clothes dryer 10 starts by detecting the start of the dryer motor and simultaneously starting a timer. A voltage of the line current used to power the motor is determined. The closure of the centrifugal switch of the motor 32 is detected and simultaneously the timer is stopped to achieve a start time. The start time and the determined voltage are inserted into a predetermined formula for the dryer to determine a mass of the fabric load carried in the drum 22. A relationship is known between mass and drying time and this relationship can be used to approximate a drying time for the fabric load virtually as soon as the centrifugal switch is closed which typically occurs less than one second after the motor has started. This approximate drying time can be displayed on a display associated with the dryer, thereby providing the user with an indication of the approximate drying time at virtually the same time as the drying cycle is started.

In an electronically controlled dryer, various circuit arrangements can be used for detecting the start of the dryer motor, for starting a timer upon the detection of the start of the dryer motor, for determining a voltage of line current to use to power the motor, for detecting the closure of the centrifugal switch of the motor, for stopping the timer upon the detection of the closure of the centrifugal switch and for calculating the mass of the fabric load as well as the drying time for the fabric load. Although a variety of different circuit arrangements can be utilized for each of these functions in accordance with the principles of the present invention, two particular embodiments are disclosed below to comply with 35 USC §112. The present invention, and the claims, however, should not be limited to these particular disclosed embodiments, which are provided only as exemplary arrangements for carrying out the principles of the present invention.

Figure 2:
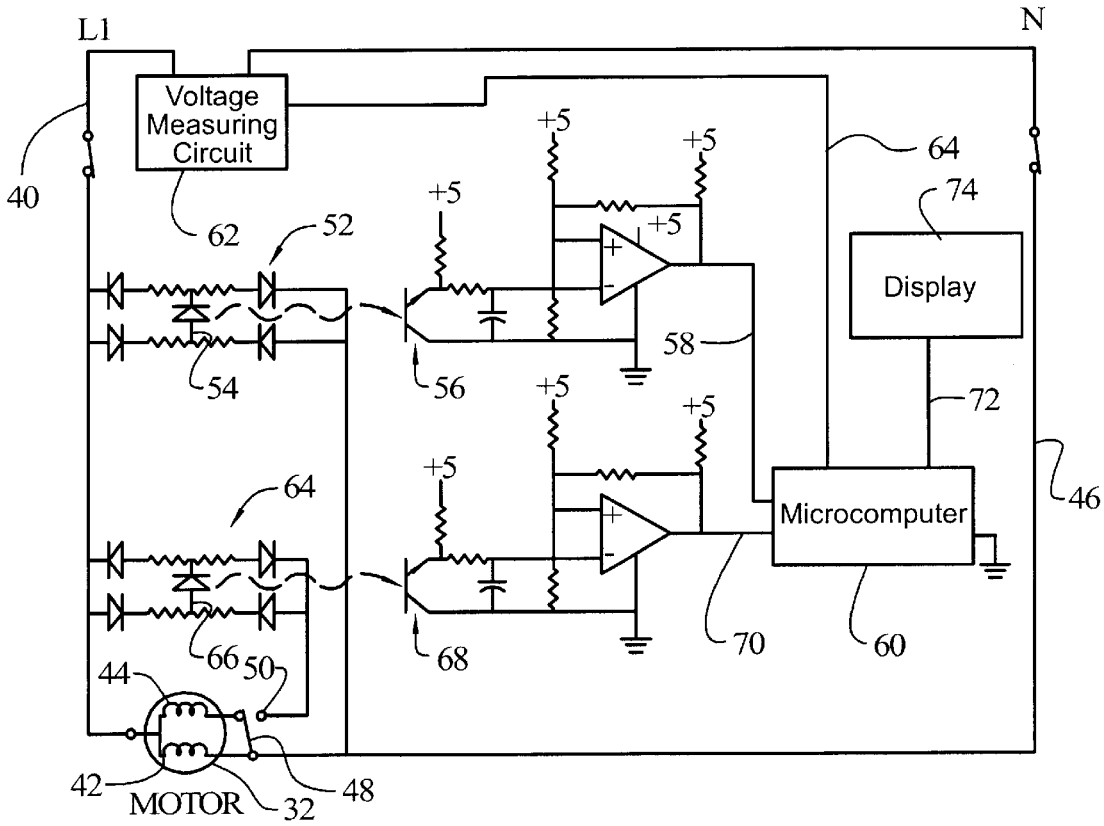
FIG. 2 is an electrical circuit diagram of one embodiment of an automatic dryer control including a mechanism for determining load size.

FIG. 2 illustrates a schematic view of a portion of the control for a dryer incorporating the principles of the present invention in a particular embodiment.

In this view, current is supplied to the motor 32 via a current supply line 40 to a main winding 42 and a start winding 44. A neutral line 46 is provided to complete the circuit. The motor includes a centrifugal switch 48 and when the motor reaches a predetermined speed, the centrifugal switch closes to maintain power to the main winding 42 and moves to make contact with terminal 50. In an embodiment of the invention, a first LED circuit 52 is provided with an LED 54 connected across the motor such that the LED 54 is energized when current is provided to the motor 32. An optical pickup arrangement 56 is provided which has a connection via line 58 to circuit element 60 such that a signal is provided to circuit element 60 immediately upon current being provided to the motor 32. Circuit element 60, which may be in the form of a microcomputer, includes a timer which is initiated upon the signal being supplied on line 58. A voltage measuring circuit element 62, which can generally be of any type well known to those skilled in the art, is used to continuously measure the voltage of the line supplying current to the motor 32. This measured voltage signal is supplied on line 64 to the circuit element 60. Circuit element 60 includes memory units for retaining a plurality of voltage measurements supplied by the voltage measuring circuit element 62.

A second LED circuit 64 is provided which extends across the motor 32 and to the centrifugal switch terminal 50 and includes an LED 66 which is energized when the centrifugal switch 48 moves to contact terminal 50, designating that the motor has reached the predetermined speed. A second optical pickup 68 is provided which provides a signal on line 70 to circuit element 60. Receipt of a signal on line 70 at circuit element 60 will terminate operation of the timer and the accumulated time in the timer is stored as a start time. A formula is stored in the memory unit of circuit element 60 which utilizes the voltage measured by the voltage measuring circuit element 62 and the stored start time to calculate an approximate mass of the load placed within the dryer drum rotated by the motor 32. This formula must be experimentally determined for each dryer drum construction and motor type and drive connection. In a particularly dryer construction tested by the inventor, a formula was determined which is $$\text{Load}=(100-0.85*\text{ADC})+((-17.7+0.171*\text{ADC})^2)*\text{Start}$$

where Load is in pounds and Start is in seconds. This formula can be determined through experimentation using small sets of start time and load mass values at nearly the same ADC values. Preferably the voltage is an average voltage measured a very short time after the motor is energized, but before the centrifugal switch 48 is moved. In the motors tested by the inventor, it was determined that it always took more than 200 milliseconds for the switch to transfer, therefore, in one embodiment of the invention, a voltage measurement can be made as an average during the time frame of 150–180 milliseconds after the motor is energized.

With the load mass determined, an estimated length of time for drying can be determined through the use of another formula empirically determined for the particular dryer. Based upon the air flow rate and heat energy input for a particular dryer, a formula can be determined to correlate mass with drying time and such formula can be stored in the memory units of circuit element 60.

This approximate drying time can be sent via line 72 to a display 74 associated with the dryer, such as a display on the console of the dryer or on a display located distant from the dryer and the line 72 can represent a direct electrical connection over wires or other types of transmission including infra red and RF signals.

Figure 3:
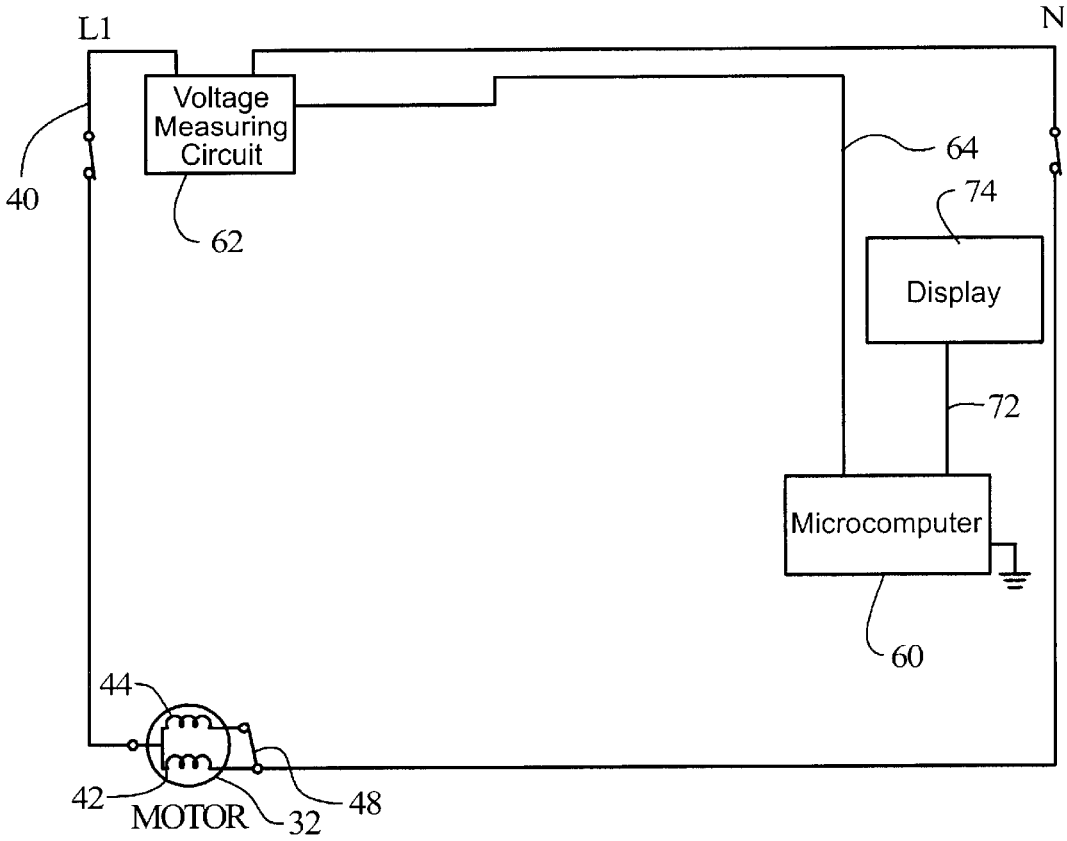
FIG. 3 is an electrical circuit diagram of another embodiment of an automatic dryer control including a mechanism for determining load size.
Figure 4:
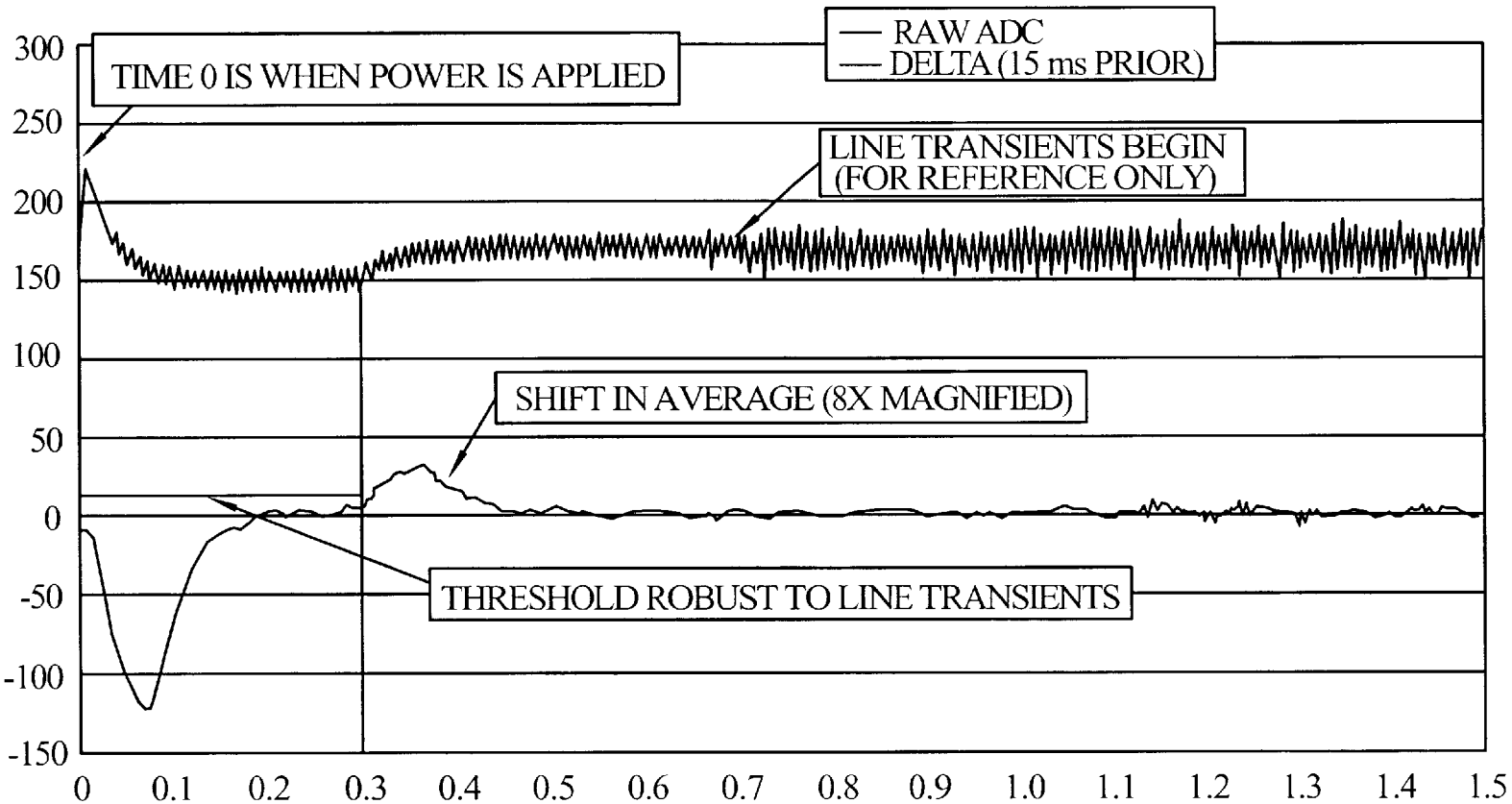
FIG. 4 is a graphic illustration of ADC measurement versus time as utilized in an embodiment of the invention.

In an embodiment of the invention shown in FIG. 3, another control arrangement is illustrated for carrying out the principles of the present invention. In this arrangement, neither the LED or optical pickup circuit are required and, instead, the time at which the centrifugal switch 48 is moved is determined from the voltages measured by the voltage measuring circuit element 62. FIG. 4 is a graphic illustration of actual voltage and change in voltage on the current supply line. In this embodiment, the voltage measuring circuit element 62 makes periodic measurements of the voltage which are provided to the circuit element 60 wherein an average of predetermined number of measurements is made and that average is compared to an average measured at a slightly earlier time period. In a specific particular embodiment of the invention, and provided only as an example, voltage measurements may be made at one second intervals and 64 of such measurements can be averaged to provide an average voltage at a given point in time. These average voltages are stored in the memory units of circuit element 60 and as each new measurement is made and each new average is determined, that new average is compared to an average determined at a time 16 milliseconds prior, since 16 milliseconds represents approximately one cycle on a 60 hertz power supply.

The difference between the two compared voltages is determined, and once the difference exceeds a predetermined value, this signifies that the centrifugal switch 48 has been moved and current is no longer flowing through the start winding 44 of the motor 32. As illustrated in FIG. 4, in the construction tested by the inventor, this occurred at approximately 0.3 seconds when the voltage differential exceeds a threshold line 76 which is sufficiently above 0 to avoid false signals due to line transients. As described above, once the start time is determined, a calculating device in the circuit element 60 can utilize the start time and the voltage measurement to calculate a mass of the fabric load in the dryer and also can calculate an approximate drying time for the fabric load once the mass has been calculated.

Measurement times for the periodic voltage measurements made by the voltage measuring circuit element 62 can vary from the one millisecond time intervals described without departing from the scope and spirit of the present invention. For example, averages based on 10 milliseconds sampling intervals can also be used, but an additional calculation would be needed to interpolate the start time to the nearest millisecond or so to provide a more precise estimate of the fabric load.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A method of determining an approximate mass of a fabric load in an automatic clothes dryer wherein the dryer utilizes a motor including a centrifugal switch which closes upon the motor achieving a predetermined speed at a start of the motor, comprising the steps:

detecting the start of the dryer motor and simultaneously starting a timer, determining a voltage of line current used to power the motor, detecting a closure of the centrifugal switch of the motor and simultaneously stopping the timer to achieve a start time, inserting the start time and the determined voltage into a predetermined formula for said dryer to calculate an approximate mass of the fabric load in the dryer.

2. A method according to claim 1, and further including the step of inserting the determined mass into a predetermined formula to approximate a drying time for the fabric load.

3. A method according to claim 2, and further including the step of displaying the approximate drying time on a display associated with the dryer.

4. A method according to claim 3, and further including the step of decrementing the remaining time as the dryer continues to operate.

5. A method according to claim 1, wherein the step of detecting the start of the dryer motor comprises detecting a flow of current in a line conductor.

6. A method according to claim 5, wherein the detection of a flow of current in a line conductor comprises placing an LED in the line conductor and utilizing an optical pickup to detect energization of the LED.

7. A method according to claim 1, wherein the step of determining a voltage of line current comprises making a plurality of measurements of the line voltage and averaging the measurements.

8. A method according to claim 1, wherein the step of detecting the closure of the centrifugal switch comprises placing an LED in a line closed by closure of said centrifugal switch and utilizing an optical pickup to detect energization of the LED.

9. A method according to claim 1, wherein the step of detecting the closure of the centrifugal switch comprises monitoring a voltage of the power supply and stopping the timer when a change in the monitored voltage is greater than a predetermined amount.

10. A method according to claim 9, wherein the step of monitoring the voltage of the power supply comprises making periodic measurements of the voltage, averaging a predetermined number of measurements and comparing the average with an average measured at a slightly earlier time period.

11. A method according to claim 10, wherein said voltage measurements are made at 1 millisecond intervals, an average is made of 64 consecutive measurements and a comparison is made with an average of 16 milliseconds prior.

12. An apparatus for determining an approximate mass of a fabric load in an automatic clothes dryer wherein the dryer utilizes a motor including a centrifugal switch which closes upon the motor achieving a predetermined speed at a start of the motor, comprising:

circuit means for detecting the start of the dryer motor, circuit means for starting a timer upon the detection of the start of the dryer motor, circuit means for determining a voltage of line current used to power the motor, circuit means for detecting the closure of the centrifugal switch of the motor, circuit means for stopping the timer upon the detection of the closure of the centrifugal switch to achieve a start time, circuit means for inserting the start time and the determined voltage into a predetermined formula for said dryer to determine a mass of the fabric load in the dryer.

13. An apparatus for determining an approximate mass of a fabric load in an automatic clothes dryer wherein the dryer utilizes a motor including a centrifugal switch which closes upon the motor achieving a predetermined speed at a start of the motor, comprising:

a timer device capable of timing intervals of time measured in milliseconds, a current detecting mechanism arranged in a current supply line for the dryer motor and arranged to start said timer upon detecting a start of the dryer motor, a voltage measuring mechanism arranged at a power supply for said motor to provide a voltage measurement, an arrangement for detecting the closure of the centrifugal switch of the motor and arranged to stop said timer upon detecting the closure of the centrifugal switch to provide a start time, a calculating device for receiving the start time and the voltage measurement and for providing a calculated mass of the fabric load in the dryer.

14. An apparatus according to claim 13, further including a calculating device for receiving the calculated mass and providing an approximate drying time for the fabric load.

15. An apparatus according to claim 13, wherein said current detecting mechanism comprises an LED positioned in said current supply line and an optical pickup for detecting energization of the LED.

16. An apparatus according to claim 13, wherein said arrangement for detecting the closure of the centrifugal switch comprises an LED positioned in a line closed by closure of said centrifugal switch and an optical pickup for detecting an energization of the LED.

17. An apparatus according to claim 13, wherein said arrangement for detecting the closure of the centrifugal switch comprises a device for monitoring a voltage of the power supply and stopping the timer when a change in the monitored voltage is greater than a predetermined amount.

18. An apparatus according to claim 17, wherein the device for monitoring the voltage of the power supply comprises a device for making periodic measurements of the voltage, averaging a predetermined number of measurements and comparing the average with an average measured at a slightly earlier time period.

19. An automatic clothes dryer comprising:

a motor including a centrifugal switch which closes upon the motor achieving a predetermined speed at a start of the motor, a rotatable drum for receiving a load of fabric to be dried and driven by said motor, a display device associated with said dryer, a timer device capable of timing intervals of time measured in milliseconds, a current detecting mechanism arranged in a current supply line of the dryer motor and arranged to start said timer upon detecting a start of the dryer motor, a voltage measuring mechanism arranged at a power supply of said motor to provide a voltage measurement, an arrangement to detect the closure of the centrifugal switch of the motor and arranged to stop said timer upon detecting the closure of the centrifugal switch to provide a start time, a calculating device arranged to receive the start time and the voltage measurement and to provide a calculated mass of the fabric load in the dryer, and a calculating device arranged to receive the calculated mass and to provide an approximate drying time for the fabric load, and a mechanism arranged to transmit said approximate drying time to said display device.

20. An apparatus according to claim 19, wherein said current detecting mechanism comprises an LED positioned in said current supply line and an optical pickup for detecting energization of the LED.

21. An apparatus according to claim 19, wherein said arrangement for detecting the closure of the centrifugal switch comprises an LED positioned in a line closed by closure of said centrifugal switch and an optical pickup for detecting an energization of the LED.

22. An apparatus according to claim 19, wherein said arrangement for detecting the closure of the centrifugal switch comprises a device for monitoring a voltage of the power supply and stopping the timer when a change in the monitored voltage is greater than a predetermined amount.

23. An apparatus according to claim 22, wherein the device for monitoring the voltage of the power supply comprises a device for making periodic measurements of the voltage, averaging a predetermined number of measurements and comparing the average with an average measured at a slightly earlier time period.

* * * * *